United States Patent [19]

Rönbeck

[11] 4,293,271

[45] Oct. 6, 1981

[54] DEVICE FOR TRANSLATING A MOVEMENT IN ONE PLANE TO A MOVEMENT IN A PLANE ESSENTIALLY PERPENDICULAR THERETO

[75] Inventor: Arne I. Rönbeck, Olofström, Sweden

[73] Assignee: AB Volvo, Goteborg, Sweden

[21] Appl. No.: 85,288

[22] Filed: Oct. 16, 1979

[30] Foreign Application Priority Data

Oct. 19, 1978 [SE] Sweden ..... 7810901

[51] Int. Cl.[3] ..... G05G 5/04

[52] U.S. Cl. ..... 414/737; 414/751; 414/744 A

[58] Field of Search ..... 414/225, 732, 737, 751–753, 414/744 A–744 C

[56] References Cited

U.S. PATENT DOCUMENTS 3,896,681 7/1975 Boyle ..... 414/744 A 4,065,118 12/1977 Dudley ..... 414/752 X

*Primary Examiner*—Robert W. Saifer

*Attorney, Agent, or Firm*—Young & Thompson

[57] ABSTRACT

A device for translating movements in one plane to movements in a perpendicular plane wherein a first member, movable on a frame with a reversible drive, has gripping arms attached to it. A second movable member is also attached to the first member and connected to the arms. The first member has a lock mechanism for the second member, interacting with stops on the frame. The drive is attached to the second member, the first and second members being releasably connected by the lock mechanism. A connector links the arms to the second member which is released from the lock mechanism when the first member as well as the arms have reached an end position. Depending on the setting of the drive, the second member continues its displacement to move the arms, via the connector, perpendicularly to the plane of movement of the first and second members.

6 Claims, 9 Drawing Figures

Figure 1:
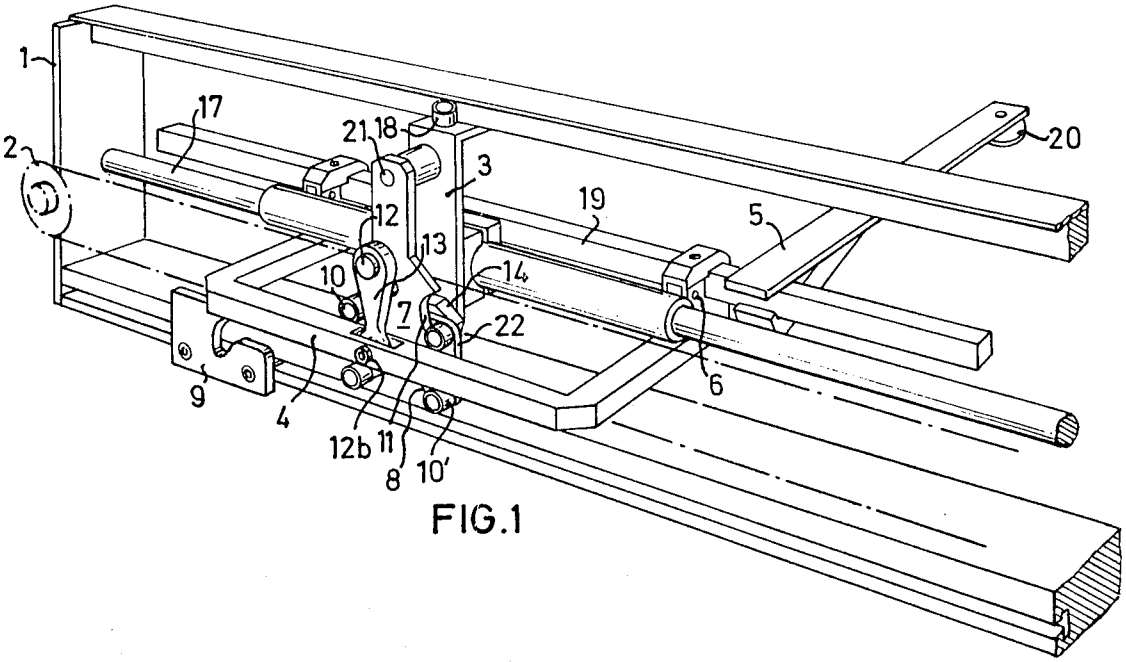

DEVICE FOR TRANSLATING A MOVEMENT IN ONE PLANE TO A MOVEMENT IN A PLANE ESSENTIALLY PERPENDICULAR THERETO

In die-cutting (punching) and pressing operations, a blank is often laid in the press, an operation is carried out, the prefinished part is picked up out of the press and is then laid into another press for finishing, and is thereafter picked up out of the press. There is often a sequence of operations in a row of presses. Putting in and picking up of parts is a monotonous and tedious job, as well as posing a danger to the operator's fingers, hands and arms, in spite of safety mechanisms, e.g. bimanual activation, which modern presses are equipped with.

Mechanisation of putting in and taking out of parts in presses, for example, is therefore highly desirable. The part is usually gripped at a pick-up location, is lifted, transported to a tool location, lowered and released. While pressing is taking place, the gripping implement must be away from the tool location, usually somewhere in the middle of the transport path, the "home position". A complete operation program could be as follows: movement from "home position" to pick-up location, lower, grip, lift, movement to tool location, lower, release, lift, movement to home position. The characteristic feature of such operation programs is that they usually involve movements in two different planes: a lifting plane and a transport plane. These two planes are usually essentially perpendicular to each other.

What is thus needed is a device in which the transport movement can be transformed, preferably at its end positions into lifting or lowering movements, and in which these movements take place in two different planes, essentially perpendicular to each other. This is entirely possible with a device according to the present invention, which eliminates all manual handling of pieces when putting in and picking up pieces from a press, for example.

Previously known solutions often have two different driving means, one for the transport movement and one for the vertical movement. They are controlled by some sort of control system, which makes sure that the order of the movements is the correct one. This involves relatively complicated solutions.

Another solution (for transport of a part) is shown in "The Industrial Robot" (March 1976), FIGS. 5*a* and 5*b*. In this construction there is only one drive means, which via a mechanical device achieves a perpendicular sinking movement at both ends of the transport, in which a spring is overcome which is suitably sized for the lifting movement.

This solution is simpler from the point of view of control than the others mentioned here but it is also mechanically complicated and unwieldy, and the change from the transport movement to the lowering movement causes noise when the device hits against a fixed stop at its end positions.

The present invention relates to a device for translating a movement in one plane to a movement in a plane essentially perpendicular thereto, the device comprising a frame with a reversible drive means for the device, a first member which is movable or swingable on the frame, said first member being provided with one or more arms with gripping means, the arms being flexibly articulated to the first member, a second movable member which is also flexibly articulated to the first member and connected to the arms, said first member being provided with a lock mechanism for the second member, the lock mechanism being arranged to interact also with stops arranged on the frame, the drive means being operatively connected to the second member and a releasable connection being arranged between the first member and the second member by means of the lock mechanism which is preferably a so-called lock rocker, the connection of the second member to the arms being arranged by means of a connecting means so that, when the first member and the arms have been displaced to an end position, the second member is released from the lock mechanism so that, depending on the setting of the drive means, the displacement or the swing of the second member continues so that the arm(s), via the connecting means, is made to carry out a movement in a plane essentially perpendicular to the plane of movement of the first and second members.

According to the invention, the arm(s) is connected with the first member via a bow, which is articulated to said first member.

According to the invention, the second member is operatively connected with the arm(s) also via the bow, by means of a link between said second member and the bow.

According to the invention, the lock mechanism in the form of a lock rocker is provided with rollers, of which at least one, and preferably two, is or are arranged to roll on edge surfaces of the second member and at least one roller to engage and roll in the stops provided on the frame.

According to the invention, the stops are provided with a slot fitted to the rollers and so shaped that the lock rocker, when the roller enters the slot, will turn and finally release the second member from the first member and lock the first member in its end position determined by the stop.

The lock mechanism of the present invention is journalled in the first member, at said journal there being a ball snap for stabilizing the lock rocker in its center (neutral) position, the sides of the ball snap, when the lock rocker is swung, also serving as stops against abutments arranged around the journalling of the lock rocker in the first member.

The length of the connecting means between the second member and the arm(s) is adjustable, according to the invention.

The amplitude of the lowering and lifting movement is determined by how large a deviation from the neutral position the drive means causes the second member to make before the drive is reversed. In order to adjust the length of transport, the stops on the frame can be moved and locked in the desired positions on the frame.

Figure 6:
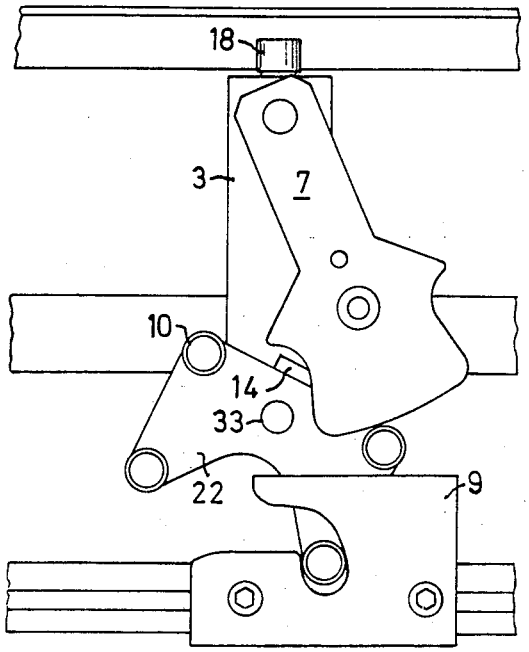
Figure 7:
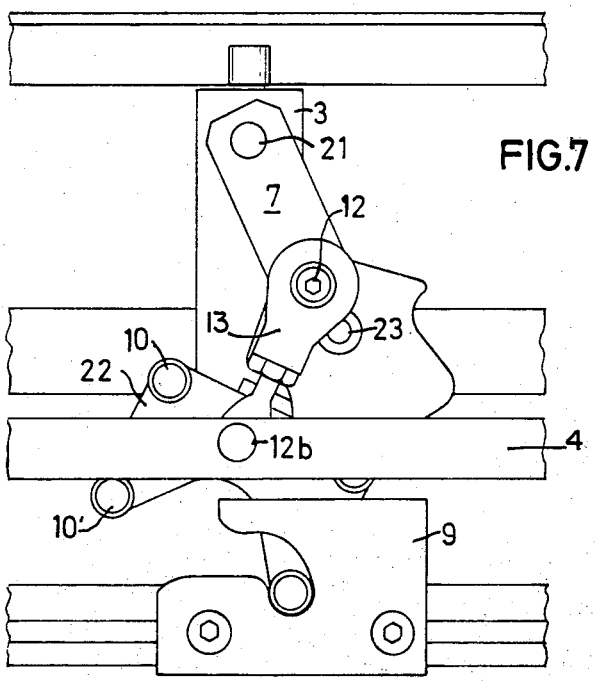

Embodiments of devices according to the invention are described below in detail with reference to the accompanying schematic drawings, in which FIG. 1 shows a perspective view of a device according to the invention, FIG. 2 parts of the locking mechanism as seen from the front, FIG. 3 an exploded perspective view from above of the so-called lock rocker taken out of its journal, FIGS. 4–6 different positions of the lock mechanism intended to illustrate the function of the mechanism, FIG. 7 the position of the lock mechanism, the link and the first member in an end position, FIG. 8 a side view of another embodiment of the invention, and FIG. 9 a horizontal projection of the parts in the embodiment according to FIG. 8.

FIG. 1 shows schematically a device according to the invention in which the transport movement is linear. In a frame 1 there is a guide 17 on which a bracket or runner 3 is disposed to move. The runner 3 is guided in the frame by means of rollers 18, for example, so that with a round guide, as in this case, the runner 3 cannot tip. A bow 4 is vertically swingably attached at 6 to the bracket or runner 3. The ends of the bow 4 are connected to each other by means of a bar 19 on which the desired number of arms 5 are fixed. The arms 5 are provided at their outer ends with gripping implements, e.g. suction cups or magnets 20. To the bracket or first member 3 a second member 7 is attached, here in the form of a pendulum swingably journalled at 21. The second member or pendulum 7 is also articulatedly connected to the bow 4 by means of the link 13. The first member or bracket 3 is also connected to the second member, the pendulum 7, via a locking mechanism, a so-called lock rocker 8. This mechanism is also swingably mounted in the first member, the bracket 3.

The lower edge surfaces 11 of the pendulum 7 are designed in such a way that rollers 10, mounted on the plate 22 of the lock mechanism, can roll against the edge surfaces 11 of the second member, the pendulum 7, until the stop 15 of the lock mechanism reaches one or the other of the abutments 16, whereafter the rolling proceeds instead against the arcuate lower edge surface 11' of the pendulum.

A stop 9 is also mounted on the frame. The stop is made so that one of the rollers 10' can slide into a specially made and shaped slot in the stop.

Figure 4:
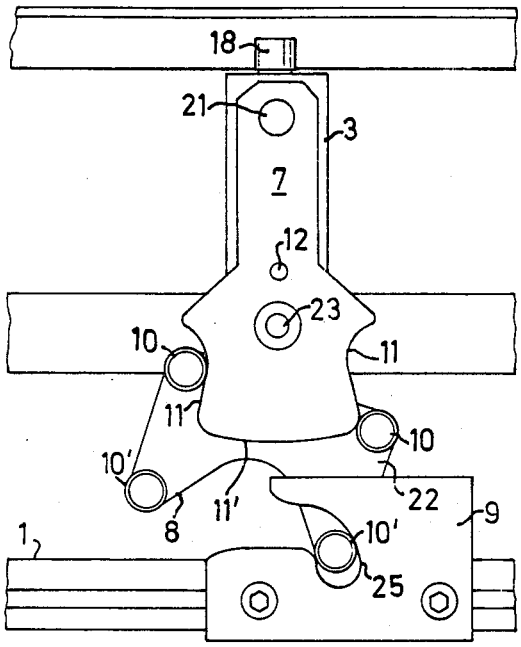

The device according to the invention is driven by a drive means 2, shown here as a sprocket with a chain, with one portion of the chain being flexibly anchored to the second member, the pendulum 7, at point 23 in FIG. 4.

Figure 3:
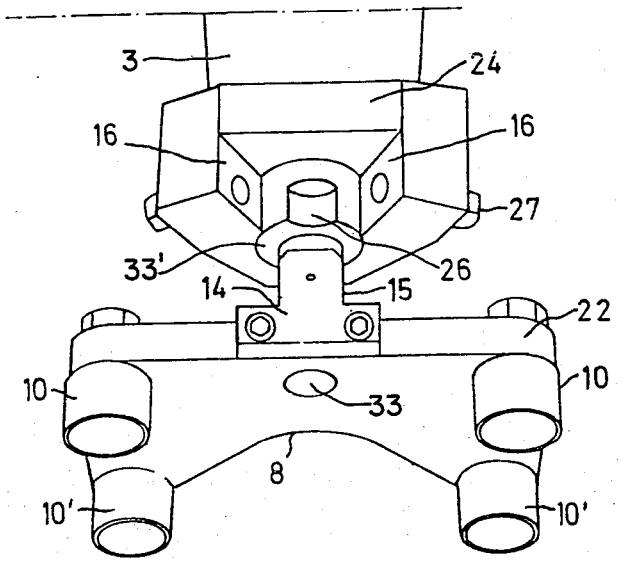

The plate 22 of the lock rocker, as shown best in FIG. 3, is journalled in the lower portion of the first member, the bracket 3, and will be described in more detail below.

In its neutral position, the lock rocker 8 locks the second member, the pendulum 7, and prevents the member 7 from swinging out in either direction. The drive means of the mechanism, which can be a reciprocally moving chain 2, or a wire, connecting rod, piston rod or the like, is driven by an electric motor or the like (not shown). As mentioned previously, the middle 12B of the bow is connected to the second member, the pendulum 7, at point 12 by means of a link 13 articulated at both ends. When the second member, the pendulum 7, is in its neutral position, the points 12B and 12 lie on a straight line through the shaft 21 of the second member, the pendulum. If the second member, the pendulum 7, is caused to swing out to the right or left, the distance between the points 12B and 21 will be shortened and this means that the bow 4 will be forced upwards and the arm 5 will be lowered by virtue of the fact that the bow is articulated to the first member, the bracket 3. This will become clearer when the functioning of the lock mechanism is described below.

Figure 2:
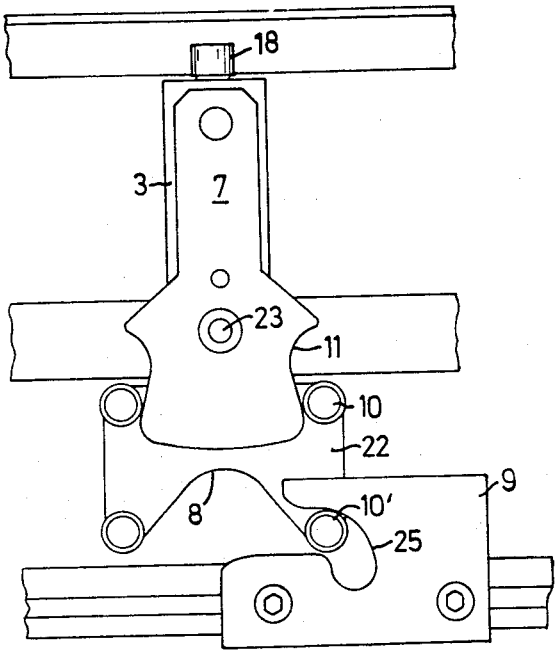

FIG. 2 shows the relative positions of the first member, the bracket 3; the second member, the pendulum 7; the lock rocker 8 and a stop 9, in this case the right-hand end stop; as a roller 10' on the lock rocker plate 22 is just entering the slot 25 in the stop. In FIG. 2, 23 designates the point of attachment for the drive means of the apparatus.

FIG. 3 shows the construction of the lock mechanism itself and the journalling in the lower portion 24 of the first member 3. Above the lock rocker shaft 33, which for clarity of illustration is shown spaced from its journal 33 in this exploded perspective view, there is a ball snap comprising a horizontally extending bracket arm 14 containing a spring (not shown) and a ball (not shown) which fits into the identation 26. The sides 15 of the ball snap bracket arm 14 also function as stops against the abutments 16, which are adjustable by means of screws labelled 27 in the drawing. The upper rollers 10 of the lock rocker 22 each support a curved edge surface on the second member, the pendulum (FIGS. 2 and 4).

We will now describe the functioning of the invention in more detail.

When the first member 3 is moved by means of the reversible drive means 2 to the right, for example, on the guide 17, the lower right-hand 10' on the lock mechanism will eventually enter the slot 25 in the right-hand stop 9. (See FIG. 2.) Up to the point shown in FIG. 4, the drive chain has moved the first member, the bracket 3, with other parts attached thereto, linearly along the guide 17. This has been possible because the drive means is attached to the second member at the point 23 and the second member, the pendulum 7, during this linear movement was locked by means of the lock mechanism 8 to the first member, the bracket 3. In the position shown in FIG. 4, the release has just been initiated of the second member, the pendulum 7, from the first member, the bracket 3.

Figure 5:
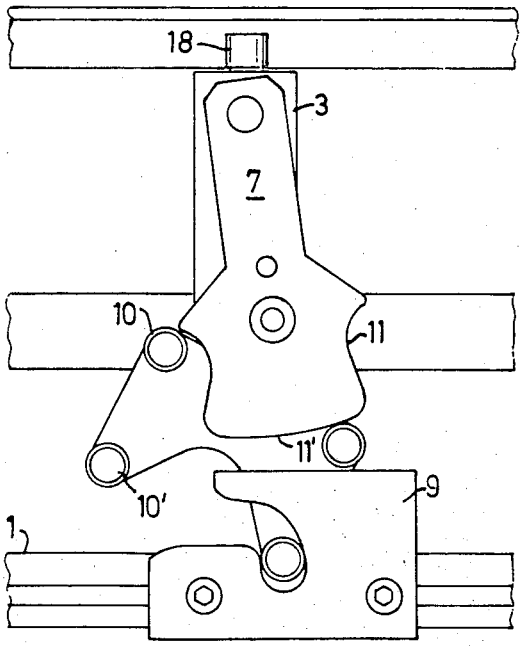

As can be seen in FIG. 5, when the upper right-hand roller 10 on the lock plate 22 to the lock mechanism 8 has subsequently come under the lower edge surface 11 of the pendulum 7, said pendulum will begin to swing out, in this case to the right. This swing has continued even farther in FIG. 6. When the second member, the pendulum 7, swings out to the right, the pendulum pulls with it the link 13 and the distance between the point 12B and the point 21 (the journal of the second member, the pendulum 7, in the first member, the bracket 3 is reduced, which means that the portion of the bow 4 which is attached to the link 13 will be raised. Due to the fact that the bow is attached at 6 to the first member (the bracket 3), the arm 5 with the gripping device will be lowered. Thus a horizontal movement of the gripping device changes in the end position to a vertical movement. This is illustrated in FIG. 7, and the corresponding sequence takes place if the second member, the pendulum 7, swings out to the left when the first member, the bracket 3, is transported to the left.

Figure 8:
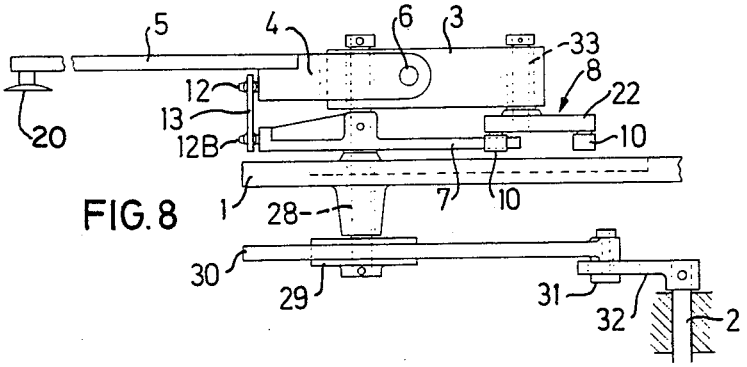
Figure 9:
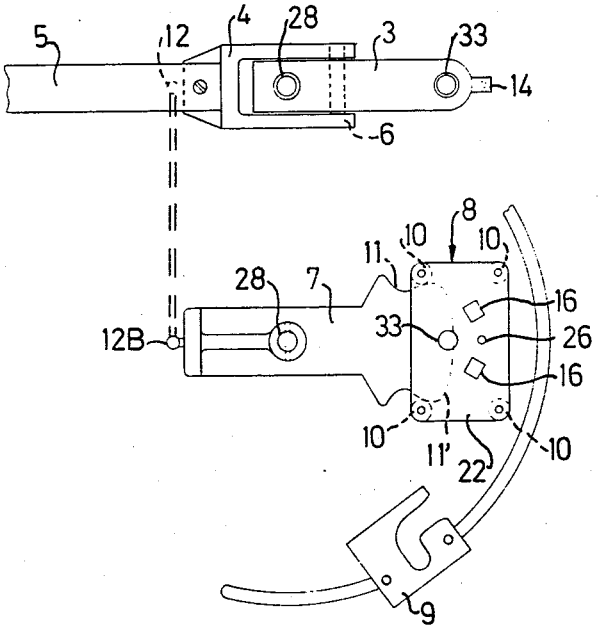

FIGS. 8 and 9 show another embodiment of the device according to the invention, where the transport movement is along an arc, that is, it is a swinging movement. As in the embodiment described above, this device comprises, as according to FIGS. 1–7, a first member (the bracket 3), a second member (a pendulum 7), a lock mechanism 8 with four rollers, a bow which is articulated via a journal 6 to the first member 3, a frame 1, a drive means 2 and one or more arms 5 attached to the bow 4. In this device, the first member, the bracket 3, is journalled on a shaft 28 onto which the second member, the pendulum 7, is rigidly mounted.

In this embodiment the pendulum 7 has at one end, in a manner similar to the embodiment according to FIGS. 1–7, shaped edge surfaces 11 and 11' against which the rollers 10 and 10' of the lock mechanism are intended to roll. At the other end of the pendulum the link 13 is articulated at point 12*b* and the other end of the link 13 is articulated at point 12 on the bow 4 (FIG. 8). The plate 22 of the lock mechanism 8 is turnably journalled on a shaft 33 through the first member, the bracket 3. Shaft 28 is driven via a gear 29, a rack 30 and an adjustable crank pin on a crank 32 from a drive shaft 2.

As can be seen from FIG. 9, in the frame 1 there is a circular track along which the stops 9 can be moved and placed in the desired positions. The arm 5 is, as usual, provided with a gripping means 20, e.g. a suction cup or a magnet or another suitable device.

If the arm 5 swings, the bracket 3 with the lock mechanism 8 will come into the vicinity of an end stop 9 in an end position. There the sequence is repeated which was described in connection with the first embodiment according to FIGS. 4–7. Since in this embodiment the first member, the bracket 3, is freely journalled on the shaft 28 but during the swinging movement is at the same time locked by means of the lock mechanism 8 to the second member (the pendulum 7), the bow 4, with the arm 5, mounted on the first member (the bracket 3) will make a swinging movement. When the first member 3 is locked by means of the lock mechanism 8 in an end stop 9 by means of one of the rollers 10' on the lock plate 22, and the second member (the pendulum 7), is released from the first member (the bracket 3), via the lock mechanism 8, the second member (the pendulum 7) can swing out farther, thus shortening the vertical distance between the points 12 and 12B in FIG. 8, and this in turn pulls the bow 4 with the arm downwards.

Thus a horizontal movement, in the first embodiment a rectilinear horizontal movement and in the second embodiment an arcuate horizontal movement, is transformed by means of the device according to the invention into a vertical movement, i.e. a movement in one plane has been transformed into a movement in another plane which is essentially perpendicular to the first plane.

On the lock plate 22 in the lock mechanism 8 according to the second embodiment there is, as in the first embodiment, a ball snap bracket arm 14, supporting a spring and a ball as before, abutments 16 for the ball snap and an indentation 26 in which the ball rests in the neutral position.

What I claim is:

1. Device for translating a movement in one plane to a movement in a plane essentially perpendicular thereto, the device comprising a frame with a reversible drive means for the device, a first member which is movably on the frame, said first member being provided with at least one arm with gripping means, the arm being articulated to the first member, a second movable member which is also articulated to the first member which is also articulated to the first provided with a lock mechanism for the second member, the lock mechanism being arranged to also interact with stops arranged on the frame, the drive means being connected to the second member; a releasable connection between the first member and the second member by means of the lock mechanism; and the connection of the second member to the arms being by means of a connecting means so that, when the first member and the arm have been displaced to an end position, the second member is released from the lock mechansim so that, depending on the setting of the drive means, the movement of the second member continues, so that the arm, via the connecting means, is made to carry out a movement in a plane essentially perpendicular to the plane of movement of the first and the second members.

2. Device according to claim 1, characterized in that the arm is connected with the first member via a bow which is articulated to said first member.

3. Device according to claim 1, characterized in that the second member is operatively connected with the arm also via the bow, by means of a link between said second member and the bow.

4. Device according to claim 1, characterized in that the lock mechanism is provided with rollers of which at least one is arranged to roll on edge surfaces of the second member and at least one roller to engage and roll in the stops provided on the frame.

5. Device according to claim 1, characterized in that the stops are provided with a slot fitted to the rollers and so shaped that the lock mechanism, when the roller enters the slot, will turn and finally release the second member from the first member and lock the first member in its end position determined by the stop.

6. Device according to claim 1, characterized in that the lock mechanism is journalled in the first member, at said journal there being a ball snap for stabilizing the lock mechanism in a center position, the sides of the ball snap, when the lock mechanism is swung, also serving as stops against abutments arranged around the journalling of the lock mechanism in the first member.

* * * * *